US009548569B2

(12) United States Patent
Tanaka et al.

(10) Patent No.: US 9,548,569 B2
(45) Date of Patent: Jan. 17, 2017

(54) CONNECTOR

(71) Applicant: JAPAN AVIATION ELECTRONICS INDUSTRY, LIMITED, Shibuya-ku, Tokyo (JP)

(72) Inventors: Yukitaka Tanaka, Tokyo (JP); Chikara Kawamura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/040,802

(22) Filed: Feb. 10, 2016

(65) Prior Publication Data

US 2016/0276780 A1 Sep. 22, 2016

(30) Foreign Application Priority Data

Mar. 18, 2015 (JP) ..... 2015-055377

(51) Int. Cl.

| | |
|---|---|
| ***H01R 13/646*** | (2011.01) |
| ***H01R 13/6467*** | (2011.01) |
| ***H01R 24/68*** | (2011.01) |
| ***H01R 13/627*** | (2006.01) |

(52) U.S. Cl.

CPC ..... *H01R 13/6467* (2013.01); *H01R 13/6273* (2013.01); *H01R 13/646* (2013.01); *H01R 24/68* (2013.01)

(58) Field of Classification Search

CPC ..... H01R 13/6467

See application file for complete search history.

(56) References Cited

U.S. PATENT DOCUMENTS

| | | | | |
|---|---|---|---|---|
| 5,226,835 A * | 7/1993 | Baker, III | ..... | H01R 13/6467 439/403 |
| 5,362,257 A * | 11/1994 | Neal | ..... | H01R 13/6467 439/676 |
| 6,065,994 A * | 5/2000 | Hashim | ..... | H01R 13/6467 439/404 |
| 6,270,381 B1 * | 8/2001 | Adriaenssens | ..... | H01R 13/6467 333/1 |

(Continued)

FOREIGN PATENT DOCUMENTS

| | | |
|---|---|---|
| JP | 2012054215 A | 3/2012 |
| JP | 2013058356 A | 3/2013 |
| JP | 5669285 B1 | 2/2015 |

*Primary Examiner* — James Harvey
(74) *Attorney, Agent, or Firm* — Holtz, Holtz & Volek PC

(57) ABSTRACT

A connector is mountable on an object in an up-down direction and mateable with a mating connector along a front-rear direction perpendicular to the up-down direction. The mating connector comprises first mating contacts and second mating contacts. The connector comprises a holding member, first contacts and second contacts. Each of the first contacts has a first contact portion, a first fixed portion and a first coupling portion. The first contact portions are brought into contact with the first mating contacts. Each of the second contacts has a second contact portion, a second fixed portion and a second coupling portion. The second contact portions are brought into contact with the second mating contacts. The first coupling portions of the first contacts and the second coupling portions of the second contacts overlap with each other. The second coupling portion intersects with both the front-rear direction and the up-down direction.

12 Claims, 6 Drawing Sheets

(56) References Cited

U.S. PATENT DOCUMENTS

| | | | | |
|---|---|---|---|---|
| 9,136,623 | B2 | 9/2015 | Hamada et al. | |
| 2003/0082954 | A1* | 5/2003 | Espenshade ..... | H01R 13/6464<br>439/676 |
| 2015/0214667 | A1* | 7/2015 | Chen ..... | H01R 13/6467<br>439/676 |
| 2015/0244117 | A1 | 8/2015 | Kawamura et al. | |

* cited by examiner

CONNECTOR

CROSS REFERENCE TO RELATED APPLICATIONS

An applicant claims priority under 35 U.S.C. §119 of Japanese Patent Application No. JP2015-055377 filed Mar. 18, 2015.

BACKGROUND OF THE INVENTION

This invention relates to a connector which includes contacts constituting one differential pair for high-speed signal transmission.

JP-B 5669285 (Patent Document 1) discloses a connector of this type. Referring to FIGS. 11 to 13, the connector 900 of Patent Document 1 comprises a holding member 910, a plurality of first contacts 920 and a plurality of second contacts 930. The first contacts 920 have shapes same as each other and have signal path lengths same as each other. In addition, the second contacts 930 have shapes same as each other and have signal path lengths same as each other. Accordingly, skew is reduced in the connector 900 of Patent Document 1. As best shown in FIG. 12, the first contacts 920 and the second contacts 930 are embedded into the holding member 910 via insert-molding. The first contacts 920 and the second contacts 930 may be press-fit into the holding member 910.

SUMMARY OF THE INVENTION

It is an object of the present invention to provide a connector comprising a structure which reduces skew and which is more suitable for contacts being press-fit into a holding member.

One aspect of the present invention provides a connector which is mountable on an object in an up-down direction and which is mateable with a mating connector along a front-rear direction perpendicular to the up-down direction. The mating connector comprises a plurality of first mating contacts and a plurality of second mating contacts. The connector comprises a holding member, a first collection of first contacts and a second collection of second contacts. Each of the first contacts has a first contact portion, a first fixed portion and a first coupling portion. The first contact portions are brought into contact with the first mating contacts, respectively. The first fixed portion is to be fixed to the object. The first coupling portion couples the first contact portion and the first fixed portion with each other. The first contact portion is formed with a first press-fit portion. The first contact portion is press-fit into the holding member to be held by the holding member. The first contact portions of the first contacts of the first collection are arranged in a row in a pitch direction perpendicular to both the front-rear direction and the up-down direction. The first fixed portions of the first contacts of the first collection are arranged in a row in the pitch direction. The row of the first fixed portions is positioned rearward of the row of the first contact portions in the front-rear direction and is positioned downward of the row of the first contact portions in the up-down direction. In the pitch direction, a position of the row of the first fixed portions and a position of the row of the first contact portions are deviated from each other and overlap with each other. Each of the second contacts has a second contact portion, a second fixed portion and a second coupling portion. The second contact portions are brought into contact with the second mating contacts, respectively. The second fixed portion is to be fixed to the object. The second coupling portion couples the second contact portion and the second fixed portion with each other. The second contact portion is formed with a second press-fit portion. The second contact portion is press-fit into the holding member to be held by the holding member. The second contact portions of the second contacts of the second collection are arranged in a row in the pitch direction. The second fixed portions of the second contacts of the second collection are arranged in a row in the pitch direction. The row of the second fixed portions is positioned rearward of the row of the second contact portions in the front-rear direction and is positioned downward of the row of the second contact portions in the up-down direction. In the pitch direction, a position of the row of the second fixed portions and a position of the row of the second contact portions are deviated from each other and overlap with each other. The row of the second contact portions of the second contacts of the second collection is positioned downward of the row of the first contact portions in the up-down direction. The row of the first fixed portions and the row of the second fixed portions are arranged in the pitch direction and do not overlap with each other when the connector is seen along the front-rear direction. When the connector is seen along the front-rear direction, the first coupling portions of the first contacts of the first collection and the second coupling portions of the second contacts of the second collection overlap with each other. The second coupling portion intersects with both the front-rear direction and the up-down direction.

The second coupling portion intersects with both the front-rear direction and the up-down direction. Accordingly, as compared with the connector of Patent Document 1 whose contacts are press-fit into the holding member, the connector can cause an effect similar to that of the connector of Patent Document 1 while being prevented from being increased in size in the front-rear direction and from being increased in size in the pitch direction.

Figure 1:
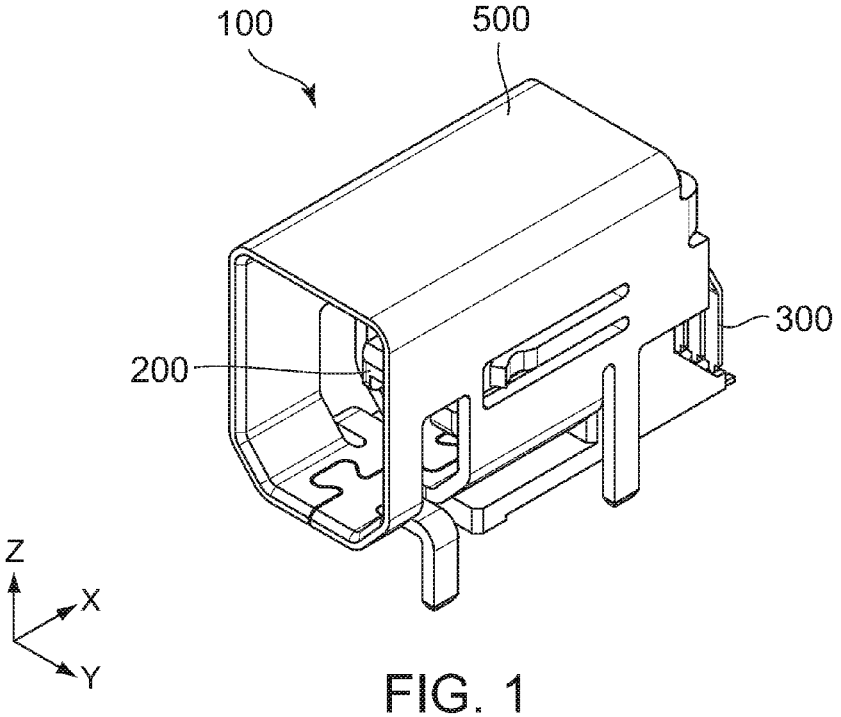
FIG. 1 is a front, perspective view showing a connector according to an embodiment of the present invention.
Figure 2:
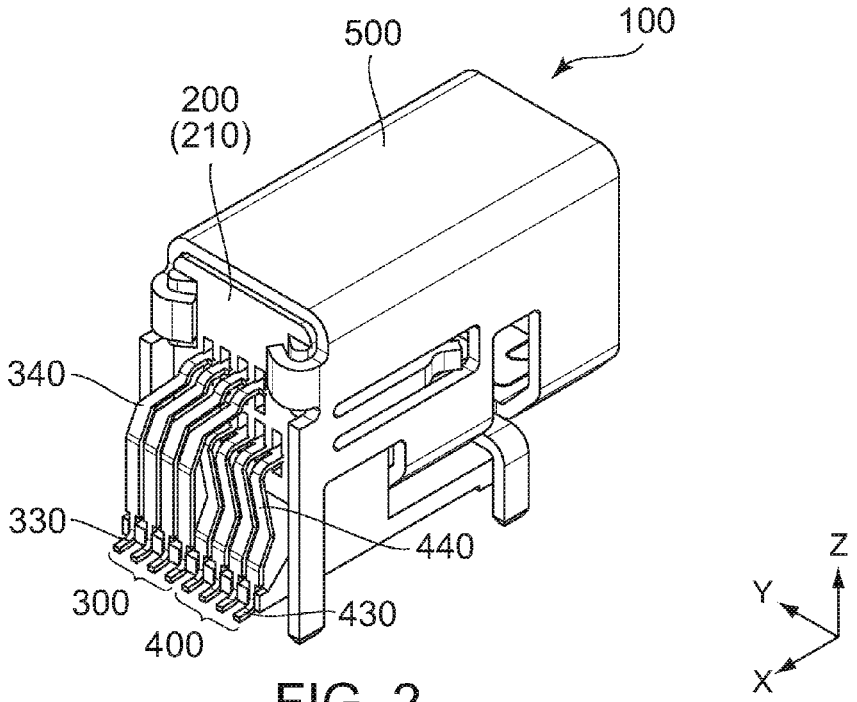
FIG. 2 is a rear, perspective view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 6, a connector 100 according to an embodiment of the present invention is mountable on a circuit board (not shown) as an object in an up-down direction, and is mateable with a mating connector (not shown) along a front-rear direction perpendicular to the up-down direction. In the present embodiment, the up-down direction is a Z-direction. A positive Z-direction is upward, and a negative Z-direction is downward. In addition, the front-rear direction is an X-direction. A negative X-direction is frontward, and a positive X-direction is rearward. The mating connector, which is not shown in figures, comprises two collections of contacts, i.e. a plurality of first mating contacts and a plurality of second mating contacts.

The connector 100 of the present embodiment comprises a holding member 200, a first collection of first contacts 300, a second collection of second contacts 400 and a shell 500. The holding member 200 is made of insulator. Each of the first contacts 300 of the first collection is made of metal. Each of the second contacts 400 of the second collection is made of metal. The shell 500 is made of metal. As a rule, the holding member 200 holds the first contacts 300 and the second contacts 400 and is surrounded by the shell 500. The first collection of the first contacts 300 is obtained by pressing a single metal plate as its base member. Similarly, the second collection of the second contacts 400 is obtained by pressing a single metal plate as its base member. Hereinafter, in order to distinguish between the metal plate, which is the base member of the first contacts 300, and the metal plate which is the base member of the second contacts 400, the former metal plate is referred to as "first metal plate", and the latter metal plate is referred to as "second metal plate". The first metal plate and the second metal plate of the present embodiment are made of materials same as each other.

Figure 3:
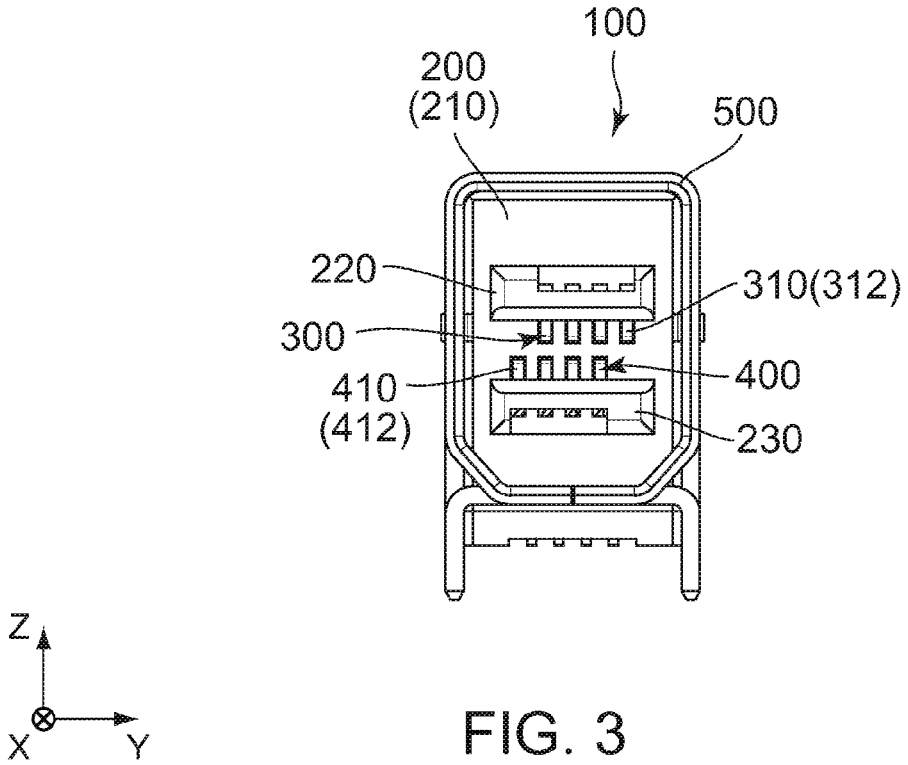
FIG. 3 is a front view showing the connector of FIG. 1.
Figure 4:
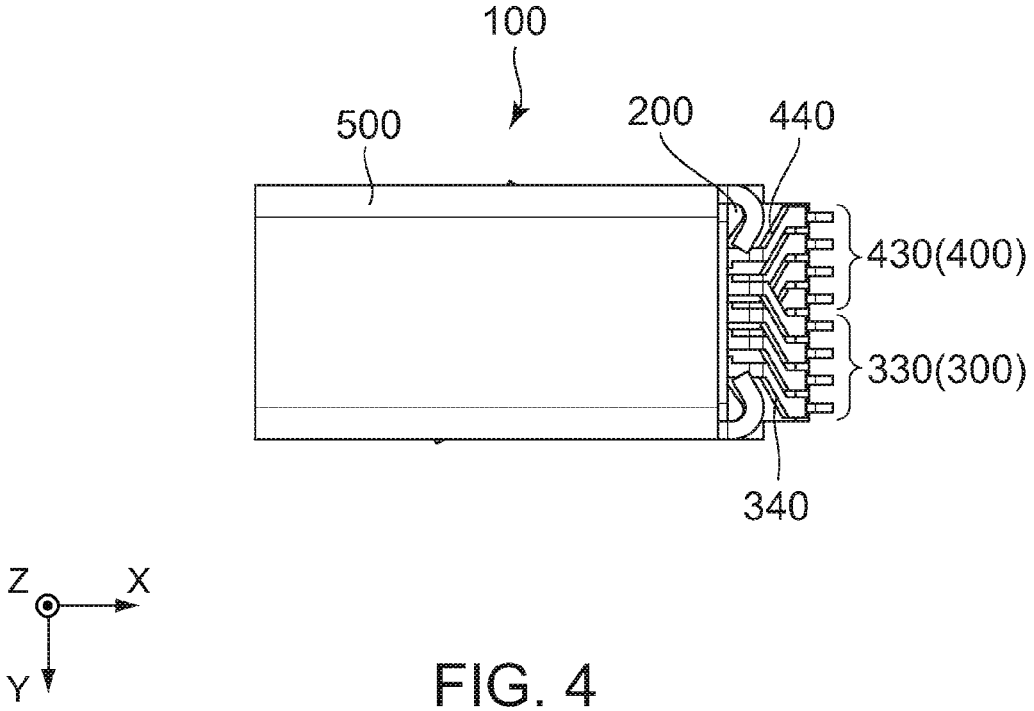
FIG. 4 is a top view showing the connector of FIG. 1.
Figure 5:
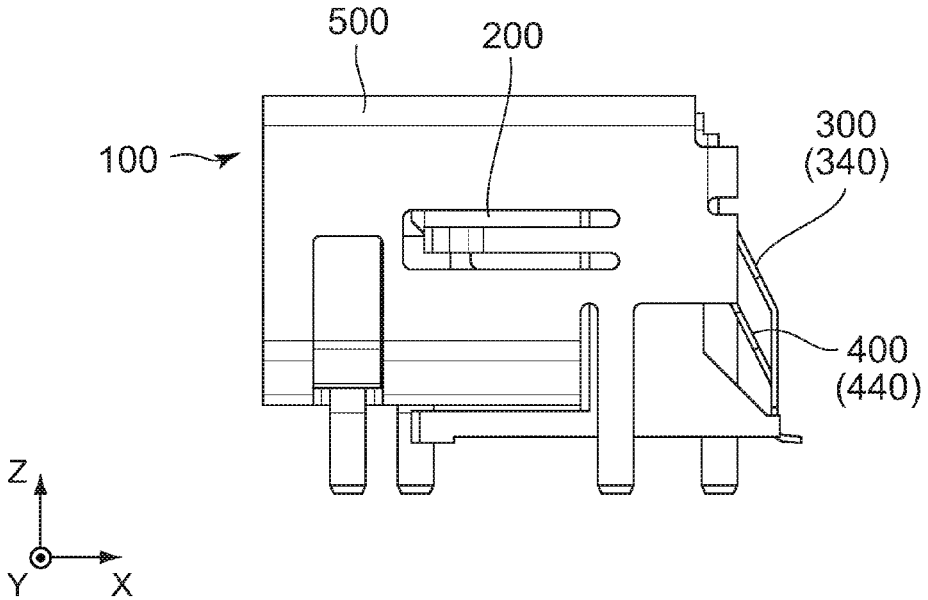
FIG. 5 is a side view showing the connector of FIG. 1.
Figure 7:
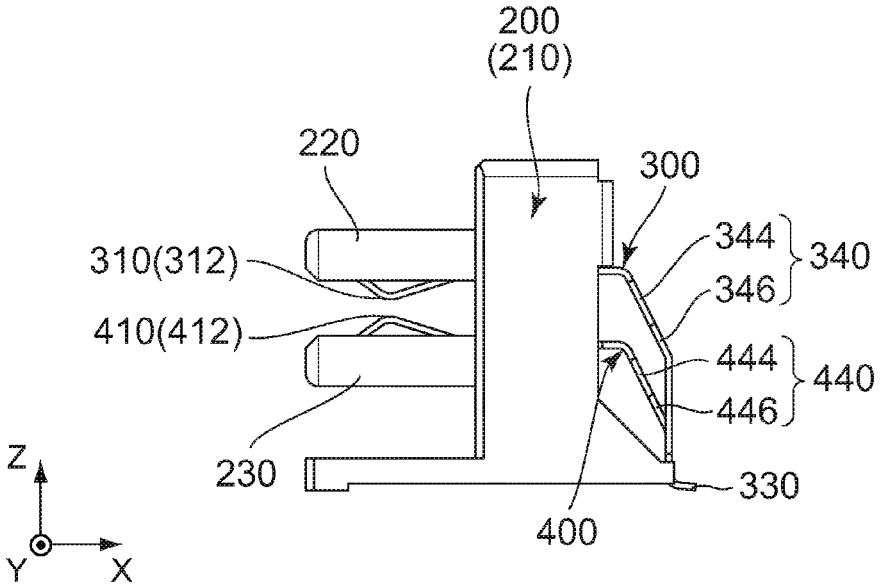
FIG. 7 is a side view showing the connector of FIG. 5, wherein a shell is omitted from the illustration.

As shown in FIGS. 3 and 7, the holding member 200 has a block portion 210, an upper plate-like portion 220 and a lower plate-like portion 230. Each of the upper plate-like portion 220 and the lower plate-like portion 230 extends frontward from the block portion 210. In the up-down direction, the upper plate-like portion 220 is positioned away from the lower plate-like portion 230 and is positioned upward of the lower plate-like portion 230.

Figure 9:
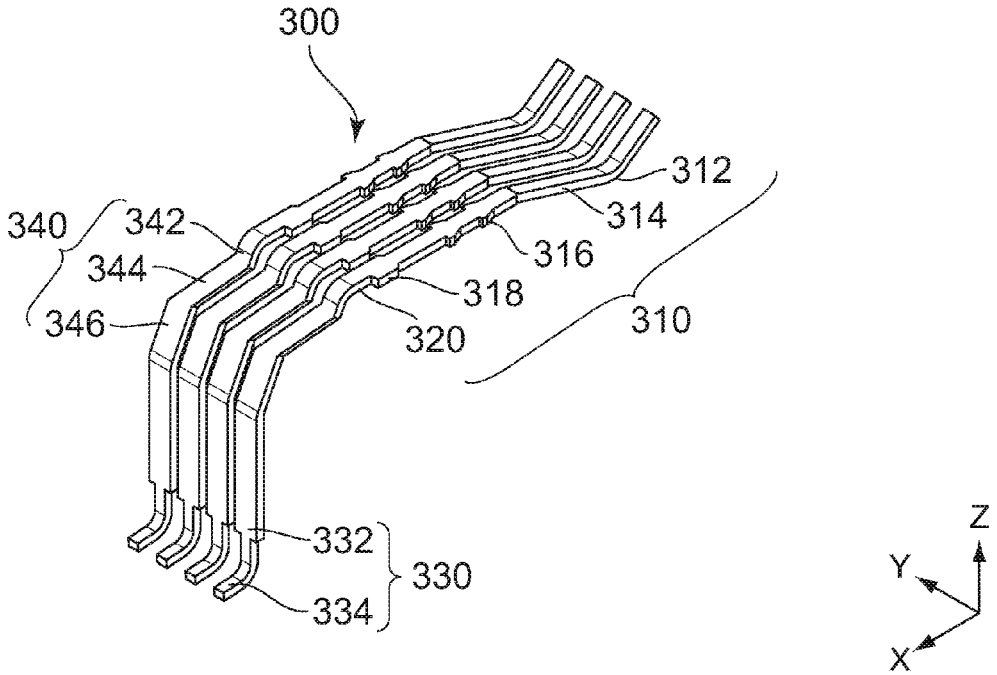
FIG. 9 is a perspective view showing a first collection of first contacts which are included in the connector of FIG. 2.

As shown in FIG. 9, the number of the first contacts 300 of the present embodiment is four, and the first contacts 300 have shapes same as each other. The first contacts 300 are arranged at regular intervals in a pitch direction perpendicular to both the front-rear direction and the up-down direction. The first contacts 300 of the present embodiment are arranged in the pitch direction so that a ground contact (G), a signal contact (S), a signal contact (S) and a ground contact (G) are arranged in this order. Specifically, the first contacts 300 include contacts which constitute one differential pair, and the ground contacts are arranged so as to interpose the differential pair therebetween in the pitch direction. Since two of the first contacts 300 which constitute the differential pair have shapes same as each other, skew can be reduced.

In the present embodiment, the pitch direction is a Y-direction. In addition, hereinafter, a negative Y-direction is referred to as "first orientation", and a positive Y-direction is referred to as "second orientation". In other words, the first orientation and the second orientation are opposite to each other in the pitch direction.

As understood from FIG. 9, each of the first contacts 300 has a first contact portion 310, a first fixed portion 330 and a first coupling portion 340. The first contact portions 310 are to be brought into contact with the first mating contacts (not shown), respectively. Each of the first fixed portions 330 is to be fixed to the circuit board (not shown). The first coupling portion 340 couples the first contact portion 310 and the first fixed portion 330 with each other.

The first contact portion 310 is formed with a first contact point 312, a first spring portion 314, a first press-fit portion 316 and a first press-fit shoulder portion 318. The first spring portion 314 is resiliently deformable and supports the first contact point 312. Accordingly, the first contact point 312 is movable in the up-down direction. The first press-fit portion 316 is positioned rearward of the first spring portion 314. As understood from FIGS. 8 and 9, the first contact portion 310 is press-fit into the holding member 200 and the first press-fit portion 316 is engaged into the holding member 200, so that the first contact portion 310 is held by the holding member 200. As shown in FIG. 9, the first press-fit shoulder portion 318 is positioned between a first rear end 320 of the first contact portion 310 and the first press-fit portion 316. The first press-fit shoulder portion 318 is a portion which is pushed frontward into the holding member 200 by using a jig when the first contact portion 310 is press-fit thereinto. The first press-fit shoulder portion 318 of the present embodiment protrudes only in the first orientation. Specifically, the first contact 300 is provided with only the single first press-fit shoulder portion 318. Thus, the first contacts 300 can be arranged at narrow intervals as compared with a structure in which two press-fit shoulder portions protrude in opposite orientations, respectively, in the pitch direction. However, the present invention is not limited thereto. Depending on intervals at which the first contacts 300 are required to be arranged, each of the first contacts 300 may have a structure in which two press-fit shoulder portions protrude in opposite orientations, respectively, in the pitch direction. The first rear end 320 of the first contact portion 310 extends in a direction perpendicular to the pitch direction.

As understood from FIGS. 3, 7 and 9, the first contact portions 310 of the first contacts 300 of the first collection are arranged in a single row in the pitch direction. In detail, each of the first contact points 312 protrudes downward from the upper plate-like portion 220. Specifically, each of the first contact points 312 protrudes toward the lower plate-like portion 230.

As shown in FIG. 9, the first fixed portion 330 has a first vertical portion 332 and a first SMT (Surface Mount Technology) portion 334. The first vertical portion 332 extends in the up-down direction in a plane perpendicular to the front-rear direction. Each of the first SMT portions 334 is to be soldered to be fixed to the circuit board (not shown), and extends rearward from a lower end of the first vertical portion 332. Accordingly, the first fixed portion 330 of the present embodiment has an L-like shape in a plane perpendicular to the pitch direction. The first fixed portion 330 may have a portion, which is suitable for through-hole technology, instead of the first SMT portion 334.

Figure 6:
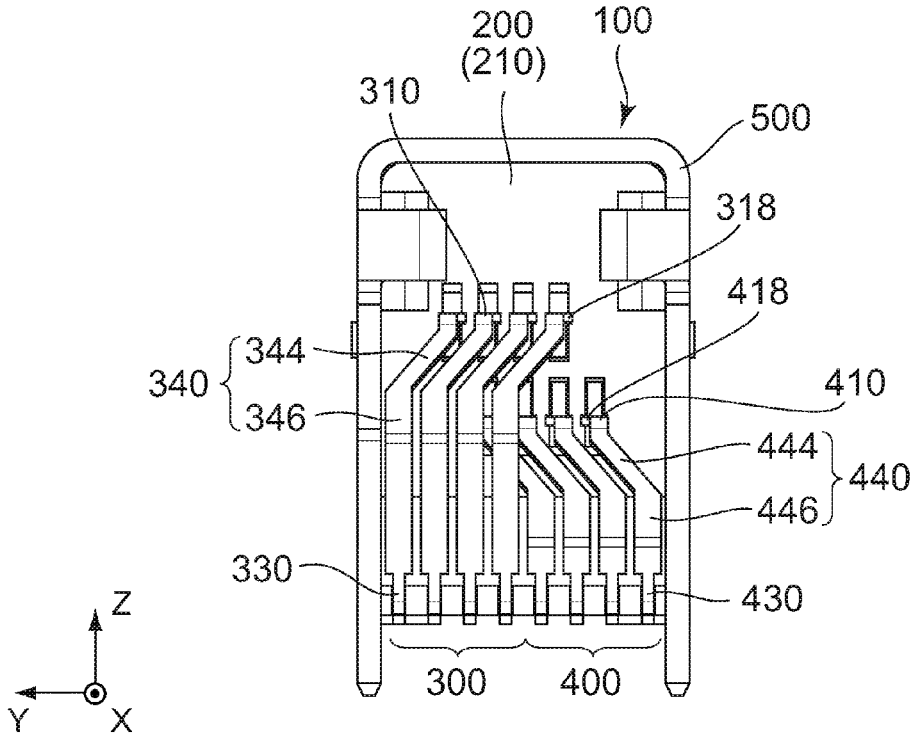
FIG. 6 is a rear view showing the connector of FIG. 1.
Figure 8:
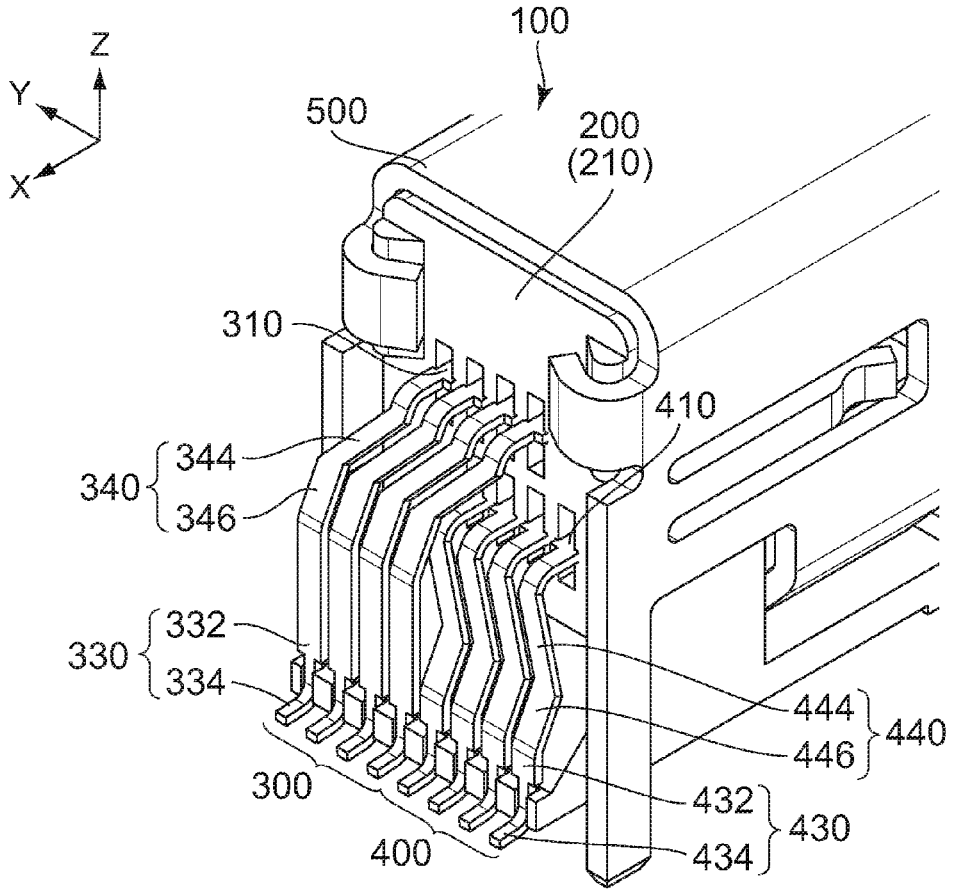
FIG. 8 is an enlarged, perspective view showing a part of the connector of FIG. 2.

As understood from FIGS. 6, 8 and 9, the first fixed portions 330 of the first contacts 300 of the first collection are arranged in a single row in the pitch direction. As understood from FIGS. 7 and 8, the row of the first fixed portions 330 is positioned rearward of the row of the first contact portions 310 in the front-rear direction and is positioned downward of the row of the first contact portions 310 in the up-down direction. As understood from FIG. 6, in the pitch direction, a position of the row of the first fixed portions 330 and a position of the row of the first contact portions 310 are deviated from each other and overlap with each other. More specifically, each of the first fixed portions 330 of the present embodiment is deviated from the first contact portion 310 in the second orientation. In other words, when each of the first fixed portions 330 is seen from the first contact portion 310, each of the first fixed portions 330 is deviated in the second orientation opposite to the first orientation in which the first press-fit shoulder portion 318 protrudes.

As understood from FIGS. 7 to 9, each of the first coupling portions 340 intersects with both the front-rear direction and the up-down direction. Specifically, each of the first coupling portions 340 of the present embodiment extends in a first oblique plane, or in a plane oblique to both the front-rear direction and the up-down direction. As shown in FIG. 9, a first front end 342 of each of the first coupling portions 340 extends from the first rear end 320 of the first contact portion 310 in a direction perpendicular to the pitch direction. Specifically, a part from the first rear end 320 of the first contact portion 310 to the first front end 342 of the first coupling portion 340 extends in the direction perpendicular to the pitch direction. Accordingly, as shown in FIG. 6, the connector 100 can have sufficient spaces each for inserting the jig which is used for pressing each of the first press-fit shoulder portions 318 frontward.

As understood from FIGS. 6, 8 and 9, each of the first coupling portions 340 has a first oblique portion 344 and a first straight portion 346 in addition to the first front end 342. In the first oblique plane, the first oblique portion 344 extends from the first front end 342 in the second orientation and extends rearward and obliquely downward. In the first oblique plane, the first straight portion 346 extends in a direction perpendicular to the pitch direction. The aforementioned first vertical portion 332 of the first fixed portion 330 extends downward from the first straight portion 346 along the up-down direction. A boundary portion between the first vertical portion 332 and the first straight portion 346 is bent in a process different from another process where the first metal plate is pressed as described above. Specifically, the boundary portion between the first vertical portion 332 and the first straight portion 346 is bent after the first contact portion 310 is press-fit into the holding member 200. The first straight portion 346 is a portion which is needed for being pinched by a tool when the boundary portion is bent as described above. Since the boundary portion between the first vertical portion 332 and the first straight portion 346 is bent after the first contact portion 310 is press-fit into the holding member 200, a position of the first fixed portion 330 can be adjusted.

As described above, the first collection of the first contacts 300 is obtained by pressing the single first metal plate. In addition, the first collection of the first contacts 300 is held by the holding member 200 so that relative positions, at which the first contacts 300 are positioned under a state where the single first metal plate is pressed, are maintained. Accordingly, a dimension of a shortest distance between the first coupling portions 340 is equal to or greater than a dimension of a thickness of the first metal plate. Specifically, a dimension of a distance between neighboring ones of the first straight portions 346 in the pitch direction is equal to or greater than the dimension of the thickness of the first metal plate. In addition, neighboring ones of the first oblique portions 344 have a distance therebetween in a direction perpendicular to a direction in which each of the first oblique portions 344 extends, and a dimension of the distance is equal to or greater than the dimension of the thickness of the first metal plate.

Figure 10:
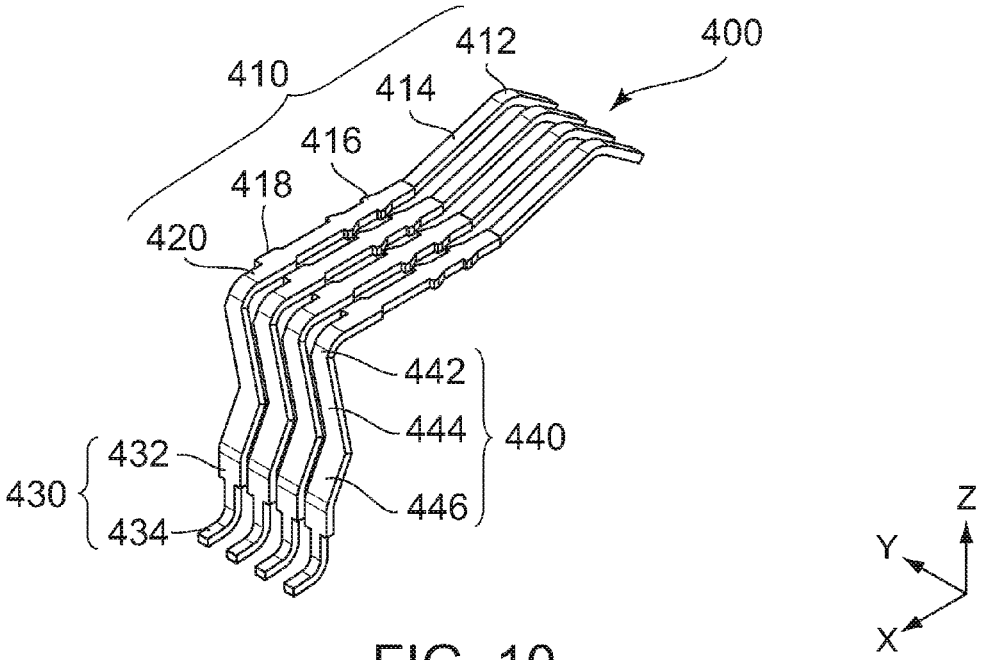
FIG. 10 is a perspective view showing a second collection of second contacts which are includes in the connector of FIG. 2.
Figure 11:
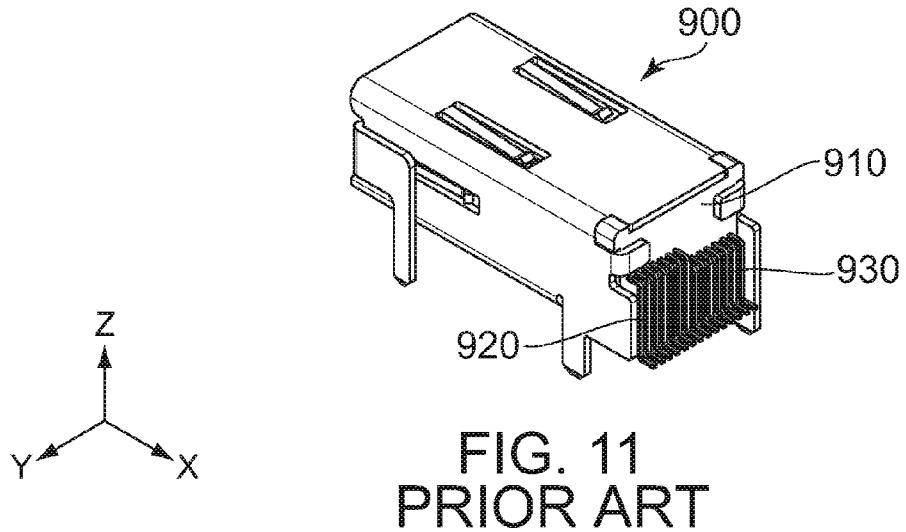
FIG. 11 PRIOR ART
FIG. 11 is a perspective view showing a connector of Patent Document 1.
Figure 12:
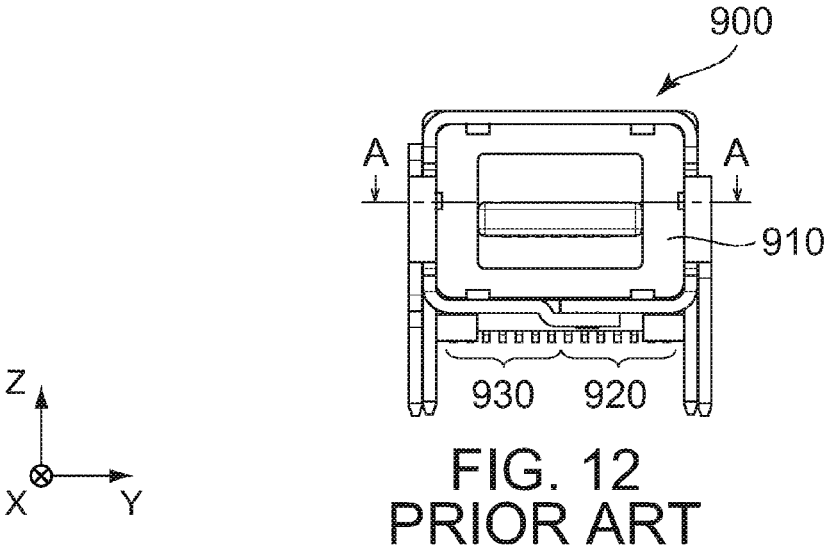
FIG. 12 PRIOR ART
FIG. 12 is a front view showing the connector of FIG. 11.
Figure 13:
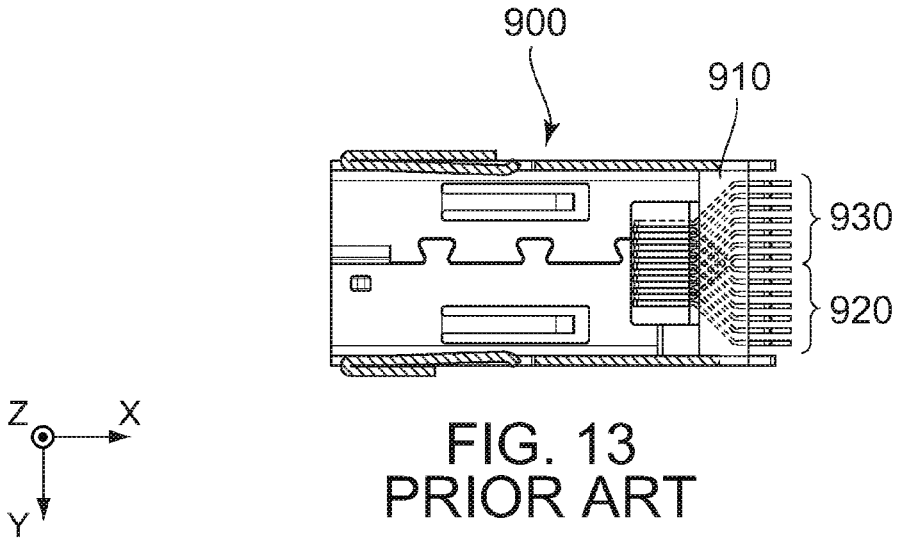
FIG. 13 PRIOR ART
FIG. 13 is a cross-sectional view showing the connector of FIG. 12, taken along line A-A.

As shown in FIG. 10, the number of the second contacts 400 of the present embodiment is four, and the second contacts 400 have shapes same as each other. The second contacts 400 are arranged at regular intervals in the pitch direction. The second contacts 400 of the present embodiment are arranged in the pitch direction so that a ground contact (G), a signal contact (S), a signal contact (S) and a ground contact (G) are arranged in this order. Specifically, the second contacts 400 include contacts which constitute one differential pair, and the ground contacts are arranged to interpose the differential pair therebetween in the pitch direction. Since two of the second contacts 400 which constitute the differential pair have shapes same as each other, skew can be reduced.

As understood from FIG. 10, each of the second contacts 400 has a second contact portion 410, a second fixed portion 430 and a second coupling portion 440. The second contact portions 410 are to be brought into contact with the second mating contacts (not shown), respectively. Each of the second fixed portions 430 is to be fixed to the circuit board (not shown). The second coupling portion 440 couples the second contact portion 410 and the second fixed portion 430 with each other.

The second contact portion 410 is formed with a second contact point 412, a second spring portion 414, a second press-fit portion 416 and a second press-fit shoulder portion 418. The second spring portion 414 is resiliently deformable and supports the second contact point 412. Accordingly, the second contact point 412 is movable in the up-down direction. The second press-fit portion 416 is positioned rearward of the second spring portion 414. As understood from FIGS. 8 and 10, the second contact portion 410 is press-fit into the holding member 200 and the second press-fit portion 416 is engaged into the holding member 200, so that the second contact portion 410 is held by the holding member 200. As shown in FIG. 10, the second press-fit shoulder portion 418 is positioned between a second rear end 420 of the second contact portion 410 and the second press-fit portion 416. The second press-fit shoulder portion 418 is a portion which is pushed frontward into the holding member 200 by using a jig when the second contact portion 410 is press-fit thereinto. The second press-fit shoulder portion 418 of the present embodiment protrudes only in the second orientation. Specifically, the second contact 400 is provided with only the single second press-fit shoulder portion 418. Thus, the second contacts 400 can be arranged at narrow intervals as compared with a structure in which two press-fit shoulder portions protrude in opposite orientations, respectively, in the pitch direction. However, the present invention is not limited thereto. Depending on intervals at which the second contacts 400 are required to be arranged, each of the second contacts 400 can have a structure in which two press-fit shoulder portions protrude in opposite orientations, respectively, in the pitch direction. The second rear end 420 of the second contact portion 410 extends in a direction perpendicular to the pitch direction.

As understood from FIGS. 3, 7 and 10, the second contact portions 410 of the second contact 400 of the second collection are arranged in a single row in the pitch direction. The row of the second contact portions 410 is positioned downward of the row of the first contact portions 310 in the up-down direction. In detail, each of the second contact points 412 protrudes upward from the lower plate-like portion 230. Specifically, each of the second contact points 412 protrudes toward the upper plate-like portion 220. Especially, in the present embodiment, the row of the first contact portions 310 and the row of the second contact portions 410 are positioned so as to be deviated from each other in the pitch direction.

As shown in FIG. 10, the second fixed portion 430 has a second vertical portion 432 and a second SMT portion 434. The second vertical portion 432 extends in the up-down direction in a plane perpendicular to the front-rear direction. Each of the second SMT portions 434 is to be soldered to be fixed to the circuit board (not shown), and extends rearward from a lower end of the second vertical portion 432. Accordingly, the second fixed portion 430 of the present embodiment has an L-like shape in a plane perpendicular to the pitch direction. The second fixed portion 430 may have a portion, which is suitable for through-hole technology, instead of the second SMT portion 434.

As understood from FIGS. 6, 8 and 10, the second fixed portions 430 of the second contacts 400 of the second collection are arranged in a single row in the pitch direction. As shown in FIGS. 6 and 8, the row of the first fixed portions 330 and the row of the second fixed portions 430 are arranged in the pitch direction, and do not overlap with each other when the connector 100 is seen along the front-rear direction. In other words, the row of the first fixed portions 330 and the row of the second fixed portions 430 form one row. As understood from FIGS. 7 and 8, the row of the second fixed portions 430 is positioned rearward of the row of the second contact portions 410 in the front-rear direction and is positioned downward of the row of the second contact portions 410 in the up-down direction. As understood from FIG. 6, in the pitch direction, a position of the row of the second fixed portions 430 and a position of the row of the second contact portions 410 are deviated from each other and overlap with each other. More specifically, each of the second fixed portions 430 of the present embodiment is deviated from the second contact portion 410 in the first orientation. In other words, when each of the second fixed portions 430 is seen from the second contact portion 410, each of the second fixed portions 430 is deviated in the first orientation opposite to the second orientation in which the second press-fit shoulder portion 418 protrudes.

As understood from FIGS. 7, 8 and 10, each of the second coupling portions 440 intersects with both the front-rear direction and the up-down direction. Specifically, each of the second coupling portions 440 of the present embodiment extends in a second oblique plane, or in a plane oblique to both the front-rear direction and the up-down direction. As shown in FIG. 10, a second front end 442 of each of the second coupling portions 440 extends from the second rear end 420 of the second contact portion 410 in a direction perpendicular to the pitch direction. In other words, a part from the second rear end 420 of the second contact portion 410 to the second front end 442 of the second coupling portion 440 extends in the direction perpendicular to the pitch direction. Accordingly, as shown in FIG. 6, the connector 100 can have sufficient spaces each for inserting the jig which is used for pressing each of the second press-fit shoulder portions 418 frontward.

As understood from FIGS. 6, 8 and 10, each of the second coupling portions 440 has a second oblique portion 444 and a second straight portion 446 in addition to the second front end 442. In the second oblique plane, the second oblique portion 444 extends from the second front end 442 in the first orientation and extends rearward and obliquely downward. In the second oblique plane, the second straight portion 446 extends in a direction perpendicular to the pitch direction. Since each of the second contacts 400 is provided with the second straight portion 446, the connector 100 can have a reduced distance between one of the second fixed portions 430, which is positioned at the innermost position in the pitch direction among the second fixed portions 430, and one of the first fixed portions 330, which is positioned at the innermost position in the pitch direction among the first fixed portions 330, without short-circuiting between the first contacts 300 and the second contacts 400. The aforementioned second vertical portion 432 of the second fixed portion 430 extends downward from the second straight portion 446 along the up-down direction. A boundary portion between the second vertical portion 432 and the second straight portion 446 is bent in a process different from another process where the second metal plate is pressed as described above. Specifically, the boundary portion between the second vertical portion 432 and the second straight portion 446 is bent after the second contact portion 410 is press-fit into the holding member 200. The second straight portion 446 is also used for being pinched by a tool when the boundary portion is bent as described above. Since the boundary portion between the second vertical portion 432 and the second straight portion 446 is bent after the second contact portion 410 is press-fit into the holding member 200, a position of the second fixed portion 430 can be adjusted.

As described above, the second collection of the second contacts 400 is obtained by pressing the single second metal plate. In addition, the second collection of the second contacts 400 is held by the holding member 200 so that relative positions, at which the second contacts 400 are positioned under a state where the second metal plate is pressed, are maintained. Accordingly, a dimension of a shortest distance between the second coupling portions 440 is equal to or greater than a dimension of a thickness of the second metal plate. Specifically, a dimension of a distance between neighboring ones of the second straight portions 446 in the pitch direction is equal to or greater than the dimension of the thickness of the second metal plate. In addition, neighboring ones of the second oblique portions 444 have a distance therebetween in a direction perpendicular to a direction in which each of the second oblique portions 444 extends, and a dimension of the distance is equal to or greater than the dimension of the thickness of the second metal plate.

When the connector 100 of the present embodiment is seen along the front-rear direction, the first coupling portions 340 of the first contacts 300 of the first collection and the second coupling portions 440 of the second contacts 400 of the second collection overlap with each other. Since each of the second coupling portions 440 intersects with both the front-rear direction and the up-down direction, each of the first contacts 300 and each of the second contacts 400 can be prevented from being brought into contact with each other without increasing a distance between the first fixed portions 330 and the second fixed portions 430.

While the present invention has been described with specific embodiments, the present invention is not limited to the aforementioned embodiments. The present invention can be variously modified.

For example, in the aforementioned embodiment, the second coupling portion 440 may be modified so as not to extend in the second oblique plane, provided that the second coupling portion 440 intersects with both the front-rear direction and the up-down direction. However, in order to shorten, as much as possible, a length of a transmitting path through which signals pass the second contact 400, it is desirable that the second coupling portion 440 extends in the second oblique plane.

Although the first coupling portion 340 intersects with both the front-rear direction and the up-down direction in the aforementioned embodiment, the present invention is not limited thereto. For example, the first coupling portion 340 may extend in a plane perpendicular to the front-rear direction. However, in order to shorten, as much as possible, a length of a transmitting path through which signals pass the first contact 300, it is desirable that the first coupling portion 340 intersects with both the front-rear direction and the up-down direction, and it is more desirable that the first coupling portion 340 extends in the first oblique plane.

In the aforementioned embodiment, the row of the first contact portions 310 and the row of the second contact portions 410 are positioned so as to be deviated from each other in the pitch direction. However, the present invention is not limited thereto. For example, the row of the first contact portions 310 and the row of the second contact portions 410 may be arranged to be positionally matched with each other in the pitch direction without any deviation therebetween. However, if the row of the first contact portions 310 and the row of the second contact portions 410 are positioned so as to be deviated from each other in the pitch direction, a distance between neighboring ones of the first contacts 300 can be properly secured by increasing an angle which the first oblique portion 344 and the first straight portion 346 make, and a distance between neighboring ones of the second contacts 400 can be properly secured by increasing an angle which the second oblique portion 444 and the second straight portion 446 make.

The present application is based on a Japanese patent application of JP2015-055377 filed before the Japan Patent Office on Mar. 18, 2015, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on an object in an up-down direction and mateable with a mating connector along a front-rear direction perpendicular to the up-down direction, wherein:

the mating connector comprises a plurality of first mating contacts and a plurality of second mating contacts;

the connector comprises a holding member, a first collection of first contacts and a second collection of second contacts;

each of the first contacts has a first contact portion, a first fixed portion and a first coupling portion;

the first contact portions are brought into contact with the first mating contacts, respectively;

the first fixed portion is to be fixed to the object;

the first coupling portion couples the first contact portion and the first fixed portion with each other;

the first contact portion is formed with a first press-fit portion;

the first contact portion is press-fit into the holding member to be held by the holding member;

the first contact portions of the first contacts of the first collection are arranged in a row in a pitch direction perpendicular to both the front-rear direction and the up-down direction;

the first fixed portions of the first contacts of the first collection are arranged in a row in the pitch direction;

the row of the first fixed portions is positioned rearward of the row of the first contact portions in the front-rear direction and is positioned downward of the row of the first contact portions in the up-down direction;

in the pitch direction, a position of the row of the first fixed portions and a position of the row of the first contact portions are deviated from each other and overlap with each other;

each of the second contacts has a second contact portion, a second fixed portion and a second coupling portion;

the second contact portions are brought into contact with the second mating contacts, respectively;

the second fixed portion is to be fixed to the object;

the second coupling portion couples the second contact portion and the second fixed portion with each other;

the second contact portion is formed with a second press-fit portion;

the second contact portion is press-fit into the holding member to be held by the holding member;

the second contact portions of the second contacts of the second collection are arranged in a row in the pitch direction;

the second fixed portions of the second contacts of the second collection are arranged in a row in the pitch direction;

the row of the second fixed portions is positioned rearward of the row of the second contact portions in the front-rear direction and is positioned downward of the row of the second contact portions in the up-down direction;

in the pitch direction, a position of the row of the second fixed portions and a position of the row of the second contact portions are deviated from each other and overlap with each other;

the row of the second contact portions of the second contacts of the second collection is positioned downward of the row of the first contact portions in the up-down direction;

the row of the first fixed portions and the row of the second fixed portions are arranged in the pitch direction and do not overlap with each other when the connector is seen along the front-rear direction;

when the connector is seen along the front-rear direction, the first coupling portions of the first contacts of the first collection and the second coupling portions of the second contacts of the second collection overlap with each other; and the second coupling portion intersects with both the front-rear direction and the up-down direction.

2. The connector as recited in claim 1, wherein the second coupling portion extends in a plane oblique to both the front-rear direction and the up-down direction.

3. The connector as recited in claim 1, wherein the first coupling portion intersects with both the front-rear direction and the up-down direction.

4. The connector as recited in claim 3, wherein the first coupling portion extends in a plane oblique to both the front-rear direction and the up-down direction.

5. The connector as recited in claim 1, wherein:

each of the second coupling portions has a second straight portion which extends in a direction perpendicular to the pitch direction; and the second fixed portion extends from the second straight portion.

6. The connector as recited in claim 1, wherein:

each of the first coupling portions has a first straight portion which extends in a direction perpendicular to the pitch direction; and the first fixed portion extends from the first straight portion.

7. The connector as recited in claim 1, wherein:

the first contact portion has a first rear end in the front-rear direction;

the first coupling portion has a first front end in the front-rear direction;

each of the first rear end and the first front end extends in a direction perpendicular to the pitch direction;

the second contact portion has a second rear end in the front-rear direction;

the second coupling portion has a second front end in the front-rear direction; and each of the second rear end and the second front end extends in a direction perpendicular to the pitch direction.

8. The connector as recited in claim 1, wherein:

the first collection of the first contacts is obtained by pressing a single first metal plate;

a dimension of a shortest distance between the first coupling portions is equal to or greater than a dimension of a thickness of the first metal plate;

the second collection of the second contacts is obtained by pressing a single second metal plate; and a dimension of a shortest distance between the second coupling portions is equal to or greater than a dimension of a thickness of the second metal plate.

9. The connector as recited in claim 1, wherein:

a first orientation and a second orientation are opposite to each other in the pitch direction;

the first contact portion is formed with a first press-fit shoulder portion which protrudes in the first orientation;

the first fixed portion is deviated from the first contact portion in the second orientation;

the second contact portion is formed with a second press-fit shoulder portion which protrudes in the second orientation; and the second fixed portion is deviated from the second contact portion in the first orientation.

10. The connector as recited in claim 1, wherein the row of the first contact portions and the row of the second contact portions are positioned so as to be deviated from each other in the pitch direction.

11. The connector as recited in claim 1, wherein:

the first contacts of the first collection have shapes same as each other; and the second contacts of the second collection have shapes same as each other.

12. The connector as recited in claim 1, wherein:

the first contacts of the first collection include contacts which constitute one differential pair; and the second contacts of the second collection include contacts which constitute one differential pair.

* * * * *